US009822542B2

(12) United States Patent
Panzella

(10) Patent No.: US 9,822,542 B2
(45) Date of Patent: Nov. 21, 2017

(54) UNIVERSAL MOTOR MOUNT AND CAP

(71) Applicant: Richard Panzella, Westbury, NY (US)

(72) Inventor: Richard Panzella, Westbury, NY (US)

( * ) Notice: Subject to any disclaimer, the term of this patent is extended or adjusted under 35 U.S.C. 154(b) by 327 days.

(21) Appl. No.: 14/599,526

(22) Filed: Jan. 18, 2015

(65) Prior Publication Data

US 2015/0204096 A1 Jul. 23, 2015

Related U.S. Application Data

(60) Provisional application No. 61/929,767, filed on Jan. 21, 2014.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; H02K 5/24
USPC ..... 248/674
See application file for complete search history.

(56) References Cited

U.S. PATENT DOCUMENTS 5,475,275 A * 12/1995 Dohogne ..... H02K 5/15 248/674
5,505,423 A * 4/1996 Kusijanovic ..... A63H 27/02 244/54
5,524,860 A * 6/1996 Ives ..... F04B 39/12 248/674
D454,539 S * 3/2002 Poag ..... D13/122
D456,773 S * 5/2002 Poag ..... D13/122
8,584,359 B1 * 11/2013 Bowman ..... F16H 1/46 29/893.1
2009/0282627 A1 * 11/2009 Porat ..... E04H 4/1281 15/1.7
2010/0288906 A1 * 11/2010 Piech ..... B66B 11/0438 248/636
2011/0156526 A1 * 6/2011 Lau ..... H02K 9/06 310/216.129
2013/0152317 A1 * 6/2013 Erlich ..... B08B 9/08 15/1.7
2013/0207491 A1 * 8/2013 Hatfield ..... H02K 3/522 310/50
2014/0081463 A1 * 3/2014 Igarashi ..... A45D 44/005 700/265
2015/0182415 A1 * 7/2015 Olkowski ..... A61H 23/02 601/93
2015/0337555 A1 * 11/2015 Hui ..... E04H 4/1636 15/1.7
2016/0145884 A1 * 5/2016 Erlich ..... E04H 4/1654 15/1.7

* cited by examiner

*Primary Examiner* — Ryan Kwiecinski
(74) *Attorney, Agent, or Firm* — Gloria Tsui-Yip; Wendi E. Uzar

(57) ABSTRACT

A universal device for capping and mounting a motor within a motorized pool cleaner housing that allows a moto pump to be installed in different brands of pool cleaners. The universal device has a base and a central through opening. At least two sets of posts extend substantially perpendicular from a surface of the base, each post is adapted to engage the housing of the pool cleaner. The first set of posts extend adjacent an edge of the base to define a first footprint. The second set of posts extend adjacent the first set of posts defining a second footprint smaller than the first footprint.

10 Claims, 10 Drawing Sheets

PRIOR ART

PRIOR ART

UNIVERSAL MOTOR MOUNT AND CAP

FIELD OF THE INVENTION

This invention relates to a pump motor mount and cap that is used in robotic swimming pool cleaners. In particular, an improved pump motor mount device is disclosed that is uniquely configured to provide a universal motor mount and cap that is capable of being installed in different robotic swimming pool cleaners having different connection means.

BACKGROUND OF THE INVENTION

Pump motors are commonly used in robotic swimming pool cleaners. Pump motors are used for pulling water through the filter of the robotic swimming pool cleaner. There are currently many different models of robotic swimming pool cleaners. Many different brands require a unique pump motor mount in order to install the pump motor within the swimming pool cleaner housing. Therefore, in order to install a pump motor within a swimming pool cleaner housing, it is required that a corresponding motor mount is used.

Therefore, there is a need for a pump motor mount that can be used to install a pump motor in different robotic pool cleaners without having to change the pump motor mount or cap.

SUMMARY OF THE INVENTION

The present invention is a pump motor mount and cap that facilitates installing a pump motor within the housing of different brands of robotic pool cleaners.

The universal motor mount and cap of the present invention comprises a base having a central opening and a plurality of post pairs extending from the base.

The universal device for capping and mounting a motor within a motorized pool cleaner comprises a base having an edge and first and second surfaces and a central through opening and at least first and second sets of posts extending substantially perpendicular from said first surface of said base, each said post is adapted to engage the housing of the pool cleaner; said first set of posts extending from said first surface of said base adjacent said edge, said first set of posts defining a first footprint, said second set of posts extending from said first surface of said base adjacent said first set of posts, said second set of posts extending from said first surface of said base adjacent said first set of posts, said second set of posts defining a second footprint smaller than said first footprint.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1A:
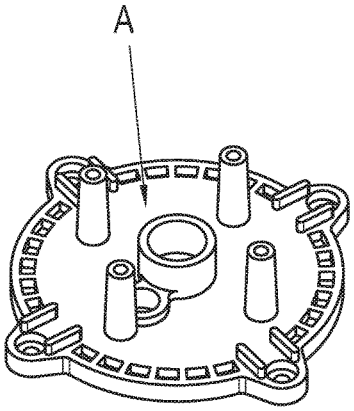
Fig.1A PRIOR ART
FIG. 1A is the top view of a prior art top flange.
Figure 1B:
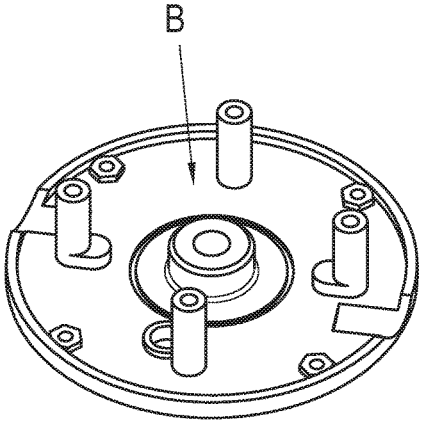
FIG. 1B is the top view of another prior art top flange.
Figure 1C:
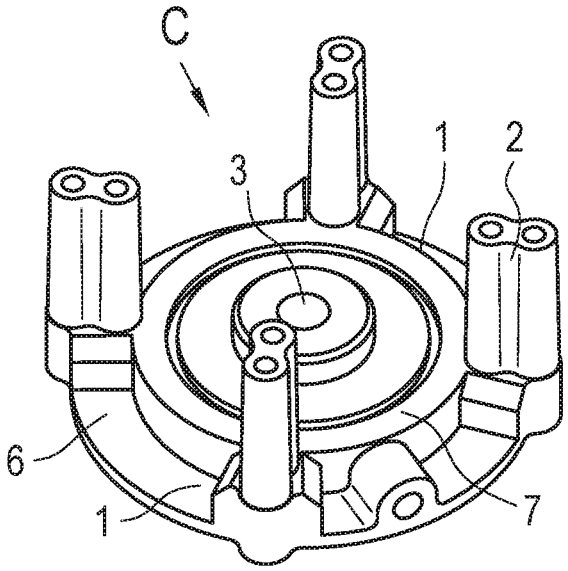
FIG. 1C is the perspective view of a first embodiment of the universal motor mount and cap of the present invention.

With reference to the drawings, wherein the same reference number indicates the same element throughout, there is shown in FIGS. 1A-B two prior art plastic motor mount top flanges A and B. A perspective view of the universal motor mount and cap of the present invention is shown as C in FIG. 1C. As shown in FIG. 1C, the universal motor mount and cap C for use within a motorized pool cleaner housing comprises a base 1, at least first and second sets of posts 2 and a central opening 3 that extends through the base 1. The base 1 has an edge and first and second opposite surfaces. As shown, the edge is the circumference of the round base 1. It is contemplated the base 1 can be any shape that corresponds to the motor of the swimming pool cleaner. The first surface of the base 1 is shown as the top surface. The second surface of the base 1 is shown as the bottom surface. The first and second sets of posts 2 extend substantially perpendicular from the first surface of the base 1 adjacent the edge. As shown in FIG. 4B, the first (and outer) set of posts define a first footprint X that in the preferred embodiment of the present invention is the circumference of the outer edge of the base 1. The second (and inner) set of posts extend from the first surface of the base 1 adjacent the first set of posts and define a second footprint Y that is smaller than the first footprint. In the preferred embodiment the second sets of posts abut the first set of posts and the second footprint has a slightly smaller circumference than the first footprint.

The universal motor mount and cap C of the present invention as shown in FIG. 1C has two motor mount transition flanges 6 and 7. In the preferred embodiment of the present invention, the motor mount of the present invention is made from aluminum. It is contemplated it can be made from other metals or plastics.

Figures 2A, 2B:
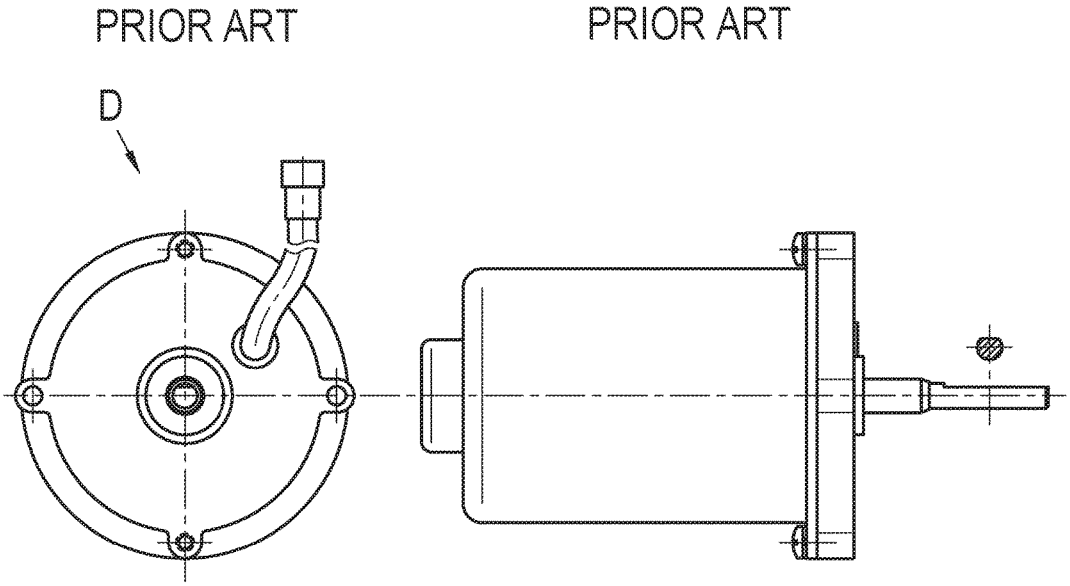
FIG. 2A is a top view of a prior art swimming pool cleaner motor housing with a cap.
FIG. 2B is a side view of FIG. 2A.

The prior art aluminum motor cap D shown in FIGS. 2A-B in combination with either top flange A or B of FIGS. 1A and B, is replaced by one aluminum motor mount (with top flange) and cap combo C with a plurality of post sets 2 as shown in FIG. 1C for installing the motor within the housing of different robotic swimming pool cleaners. In the preferred embodiment and as shown in FIG. 1C, the motor mount and cap C has two sets of posts 2, each set includes four posts, with eight total posts. As described above, the sets of posts 2 comprises an inner set of four posts defining the second footprint and an outer set of four posts defining the first footprint. The inner set of posts (i.e. closer to the center) that create the second footprint are adapted to attach to a pool cleaner that would have accepted prior art top flange A as shown in FIG. 1C. The outer set of posts (i.e. further from the center) that create the first footprint are adapted to attach to a pool cleaner that would have accepted prior art top flange B as shown in FIG. 1B. Essentially, the first and second sets of posts are concentrically positioned. While two sets of posts are shown, additional concentric sets of posts are contemplated. Similarly while four posts are shown in each set, more or less posts in each set is contemplated.

Figure 7:
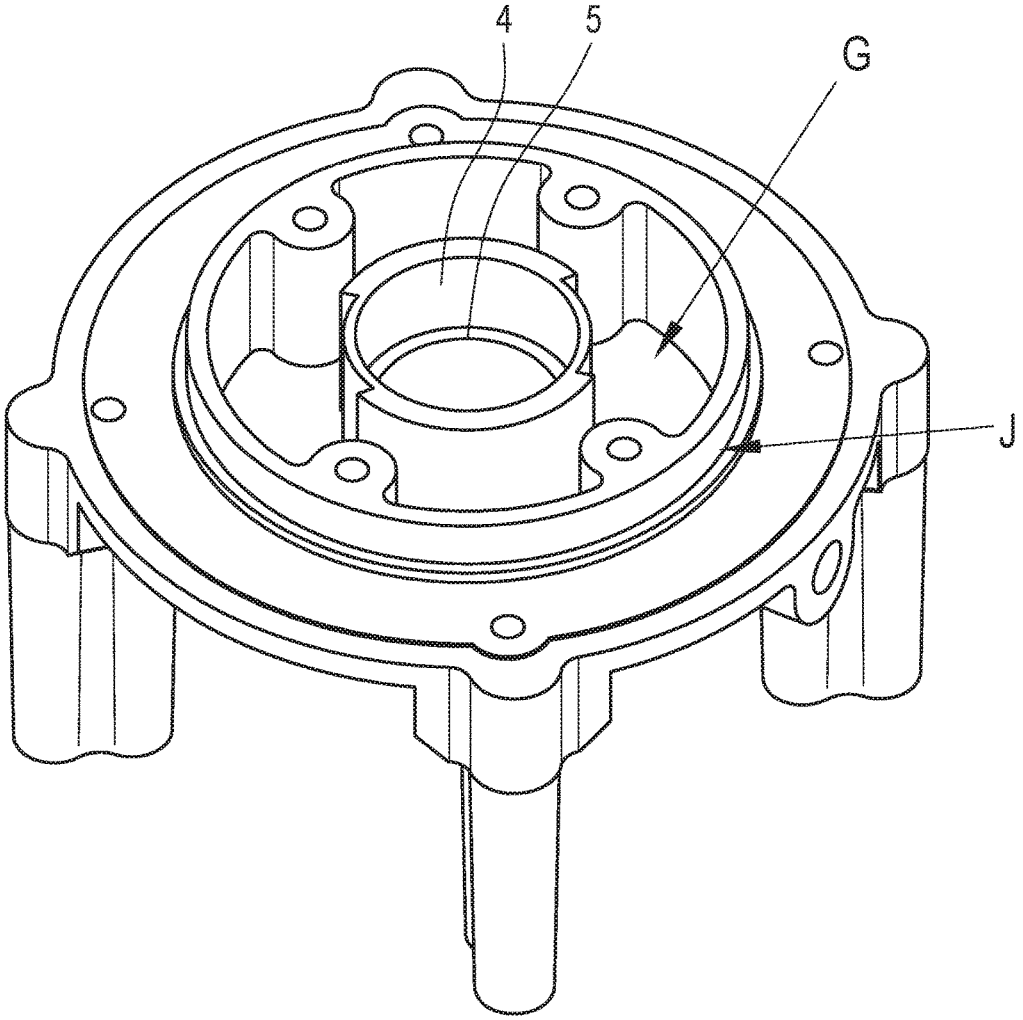
FIG. 7 is a bottom view of the universal motor mount and cap of the present invention.

In one embodiment, the universal motor mount and cap C of the present invention is designed to accept two oil seals, an outer o-ring and a middle shaft seal o-ring. The middle shaft seal o-ring is to be accepted in the central through opening 3 of the universal motor mount cap C. The universal motor mount and cap C includes a re-design of the bottom gland 4 to extend and improve the o-ring used in the middle shaft seal, which includes an o-ring that will allow the motor to operate at greater water depth and greater pounds per square inch. The bottom gland 4, the area where the o-ring sits when installed, is re-designed to be ridged and includes a lip 5 around the inside perimeter of the universal motor mount and cap C in order to secure the o-ring so it does not move out of place at higher pressures or water depths. The o-ring will be increased to about 90 durometer. In one embodiment of the present invention the o-ring is constructed from nitrile. FIG. 7 shows the bottom view of the universal motor mount and cap C. The outer o-ring is to be accepted around the rim J, as shown in FIG. 7 which is the location of the bottom universal motor mount cap C where it meets the motor housing when installed.

In one embodiment of the present invention, the central through opening 3 of the universal motor mount and cap C is designed to accept the o-ring currently available as "Twin Lipped Radial Shaft Seal" which is made of steel, wrapped in nitrile, has a stainless steel radial spring wrapped around the shaft hole diameter in between the twin lip. One such o-ring is currently available and manufactured by NAK, as NAK Part No. 8X19X7ADL. The seal will prevent water from entering into the brushed DC motor in a broad range of both low water pressure (approx. 1 psi=2.31 feet of depth) and high water pressure (approximately 15 psi=34.65 feet of depth). The prior art seal used in connection with prior art motor caps only keeps water out at low pressure of approximately 2.6 psi=6 feet. It is noted that oil seals are generally designed to either keep water out at low pressure or at high pressure, but not both low and high pressure as provided in the present invention.

The universal motor mount and cap C has two transition flanges 6 and 7 and can now replace the individual prior art cap D shown in FIGS. 2A-B and motor mount top flanges A or B shown in FIGS. 1A-B. An advantage of the present invention is that the prior art motor can be retro fitted with the universal motor mount and cap C of the present invention so that the retro fitted motor can be used with various prior art motors or fit into different prior art machine housings.

Figure 3A:
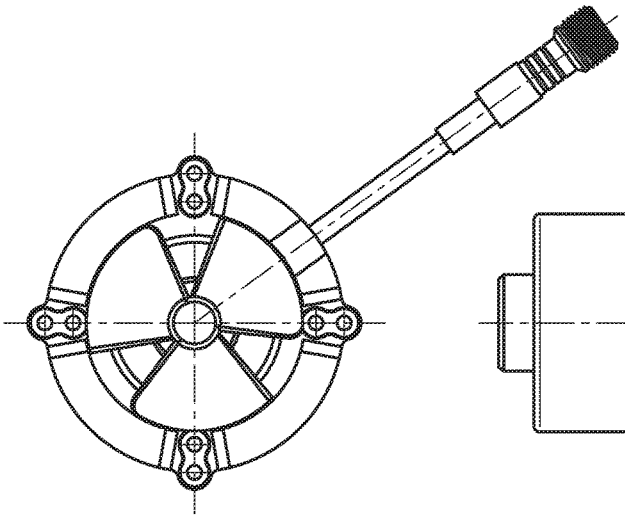
FIG. 3A is the top view of the universal motor mount and cap of the present invention mounted on a motor housing with the motor connected to a propeller.
Figure 3B:
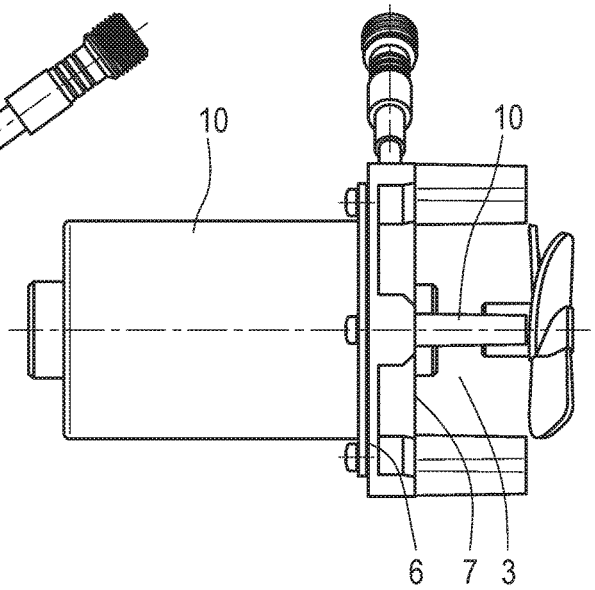
FIG. 3B is the side view of FIG. 3A.
Figure 3C:
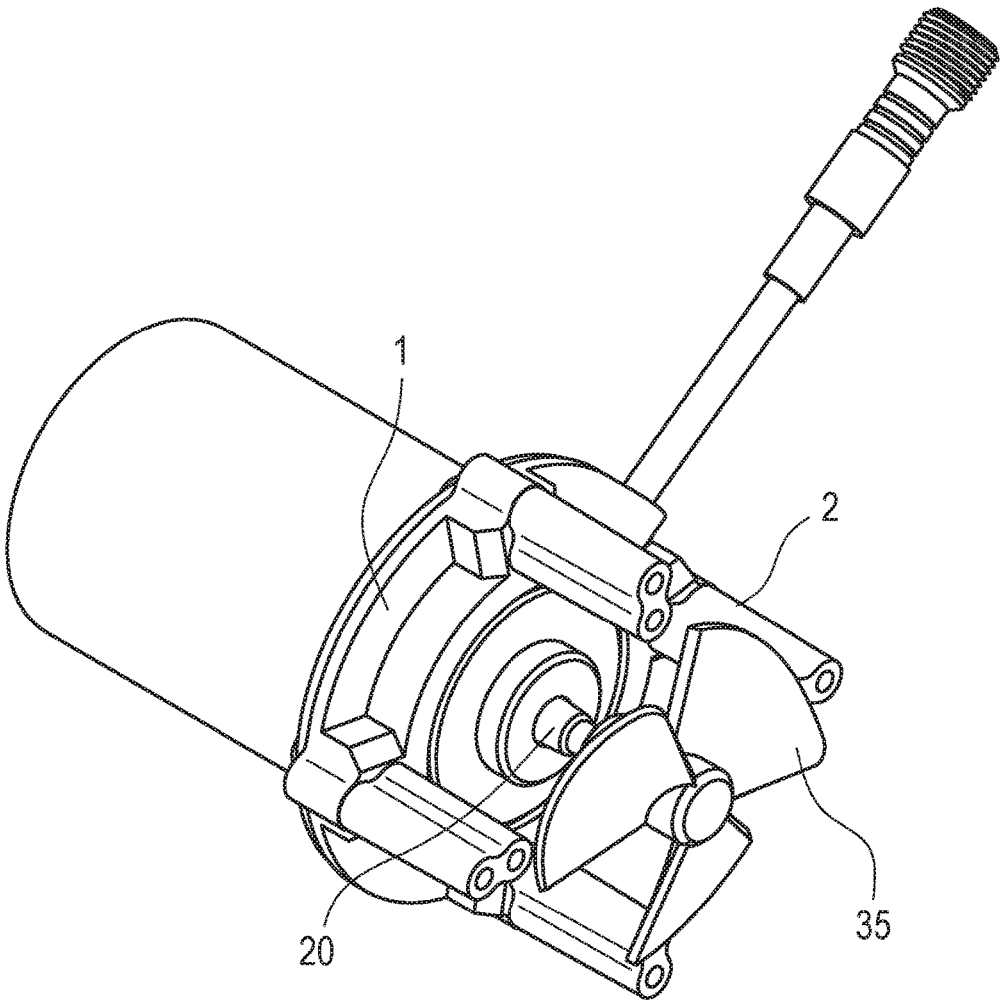
FIG. 3C is the perspective view of FIG. 3A.

The universal motor mount and cap C is bolted or attached to the brushed DC pump motor body and the two components form a complete pump motor 10, as shown in FIGS. 3A-3B, for robotic swimming pool cleaners. The shaft 20 of the pump motor extends through the central opening 3 of the mount and cap C. A propeller 35 is attached to the distal end of the shaft 20. The complete motor 10 can be installed within different pool cleaner housings utilizing either the first or second sets of posts 2.

Figure 4A:
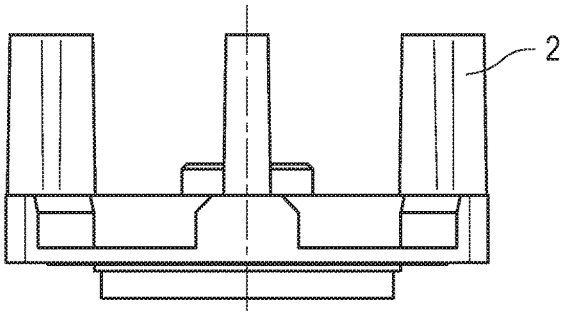
FIG. 4A is a side view of the universal motor mount and cap of the present invention.
Figure 4B:
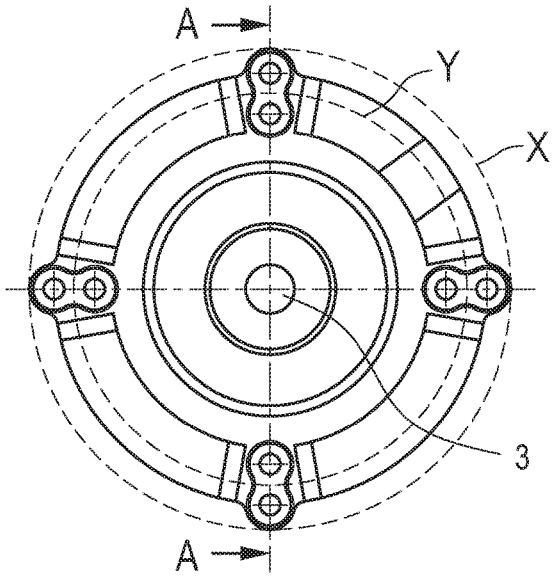
FIG. 4B is a top view of the universal motor mount and cap of the present invention.
Figure 4C:
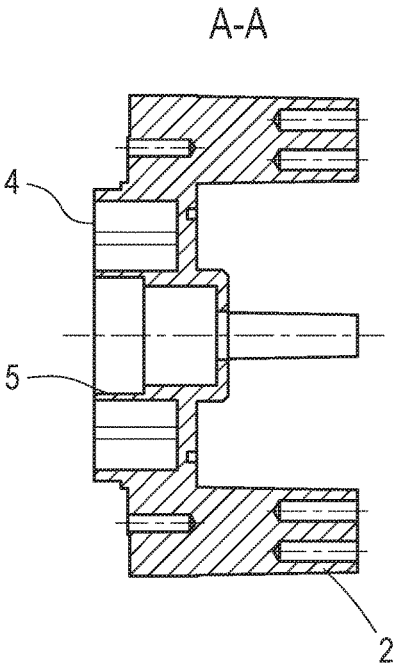
FIG. 4C is a side view of the universal motor mount and cap of the present invention.

As shown in FIGS. 4A-4C, another improvement of the present invention is that the depth of the central through opening 3 of the universal motor mount and cap C is increased compared to the prior art mounts, allowing the opening 3 of the universal motor mount and cap C to house both the "Twin Lipped Radial Shaft Seal" and the top motor bearing. The prior art motor top D can only house the top motor bearing.

In another embodiment of the present invention, the stainless steel motor shaft will be polished where it interacts with and engages the "Twin Lipped Radial Shaft Seal" to a high polished finish as listed by the Society of the Plastic Industries, a SPI #3 finish/11 to 6 micron polished finish. This extends the life of the "Twin Lipped Radial Shaft Seal" to prevent water from entering the motor.

Figure 5:
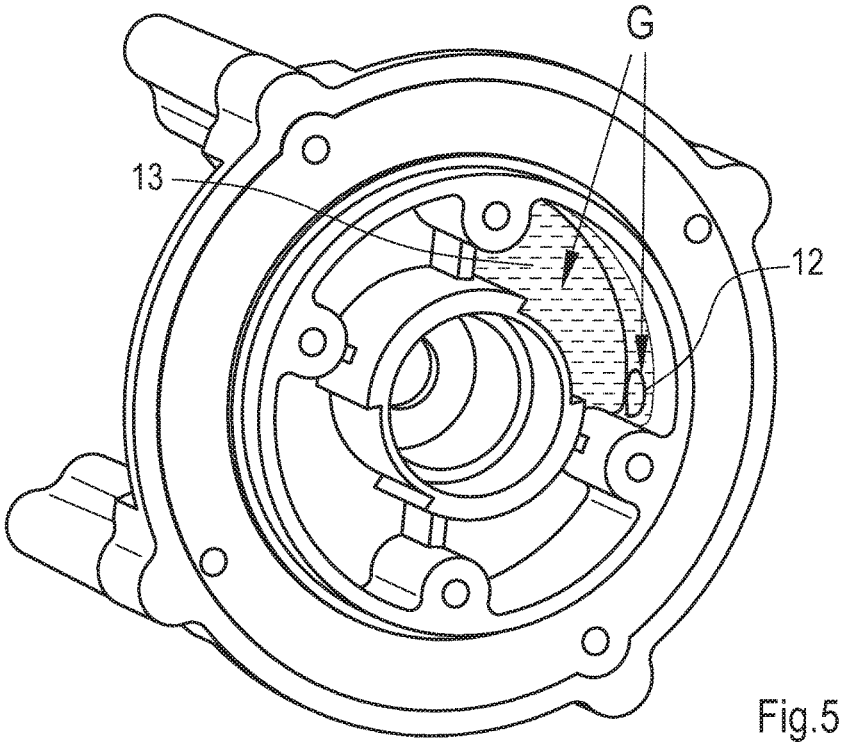
FIG. 5 is an enlarged view of the bottom view of the universal motor mount and cap of the present invention.

FIG. 5 shows another embodiment of the present invention relating to the installation of the electronic components in the universal motor mount and cap C, where the potting box area G located inside universal motor mount and cap C is capable of acting as one barrier wall of the potting box.

Figure 6:
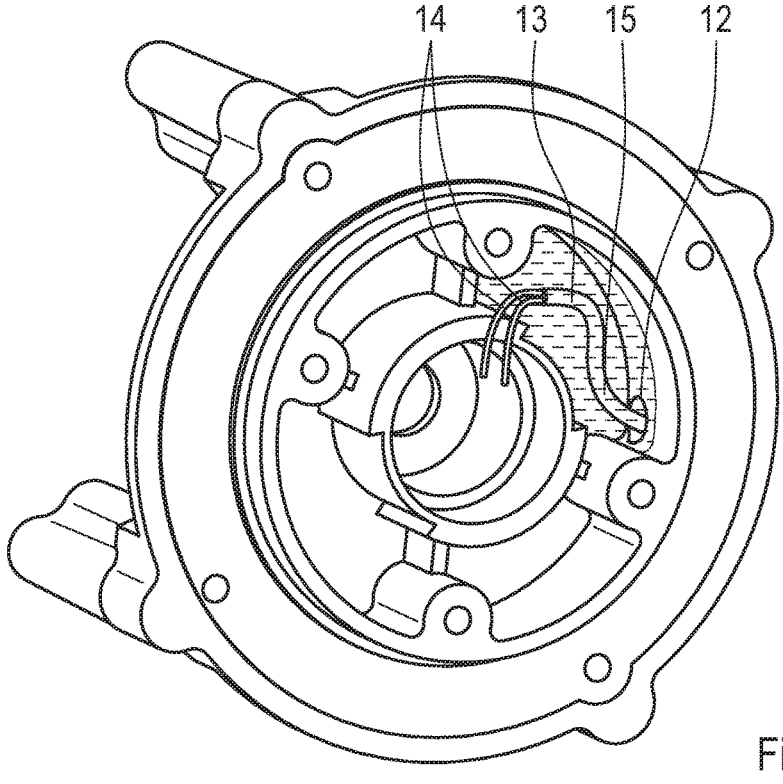
FIG. 6 is another enlarged view of the bottom view of the universal motor mount and cap of the present invention illustrating the position of the cable.

FIG. 6 shows one embodiment of the present invention for the cable installation using the universal motor mount and cap C. The method of how the cable is buried into a bed of epoxy is: first, the cable is bent ninety degrees upward from the cable hole 12, next, the two conductors elbow and rise up out of the epoxy bed ninety degrees outwardly, whereby maximizing the epoxy strength to seal out water from entering into the motor through the interior of the wire jacket and also through the cable hole 12 entrance of the universal motor mount and cap C. Bending the cable as shown before the epoxy is poured will also prevent water from entering the inside of the wire jacket inside the universal motor mount and cap C and prevent water back feeding or back flowing away from the cable hole 12 of the universal motor mount and cap C and damaging other electrical components, wiring, other electrical connections and connectors.

FIG. 7 shows the general potting box location G of the cable installation using the universal motor mount and cap C as also shown in FIGS. 5 and 6.

Figure 8:
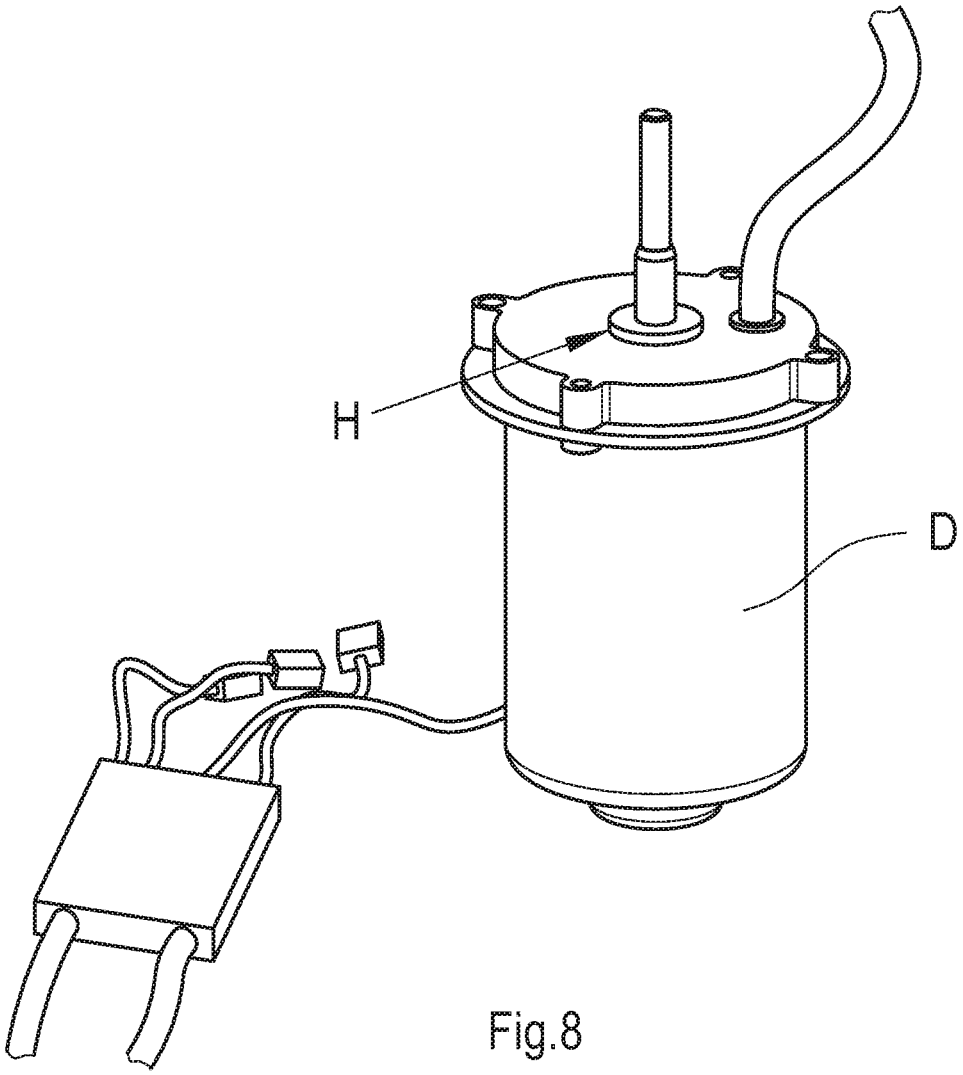
FIG. 8 is a perspective view of a prior art motor housing with a prior art cap.

The improved device also eliminates the need for the small o-ring seal H at the middle top ridge as needed in the prior art motor top cap D and as shown in FIG. 8.

Figure 9:
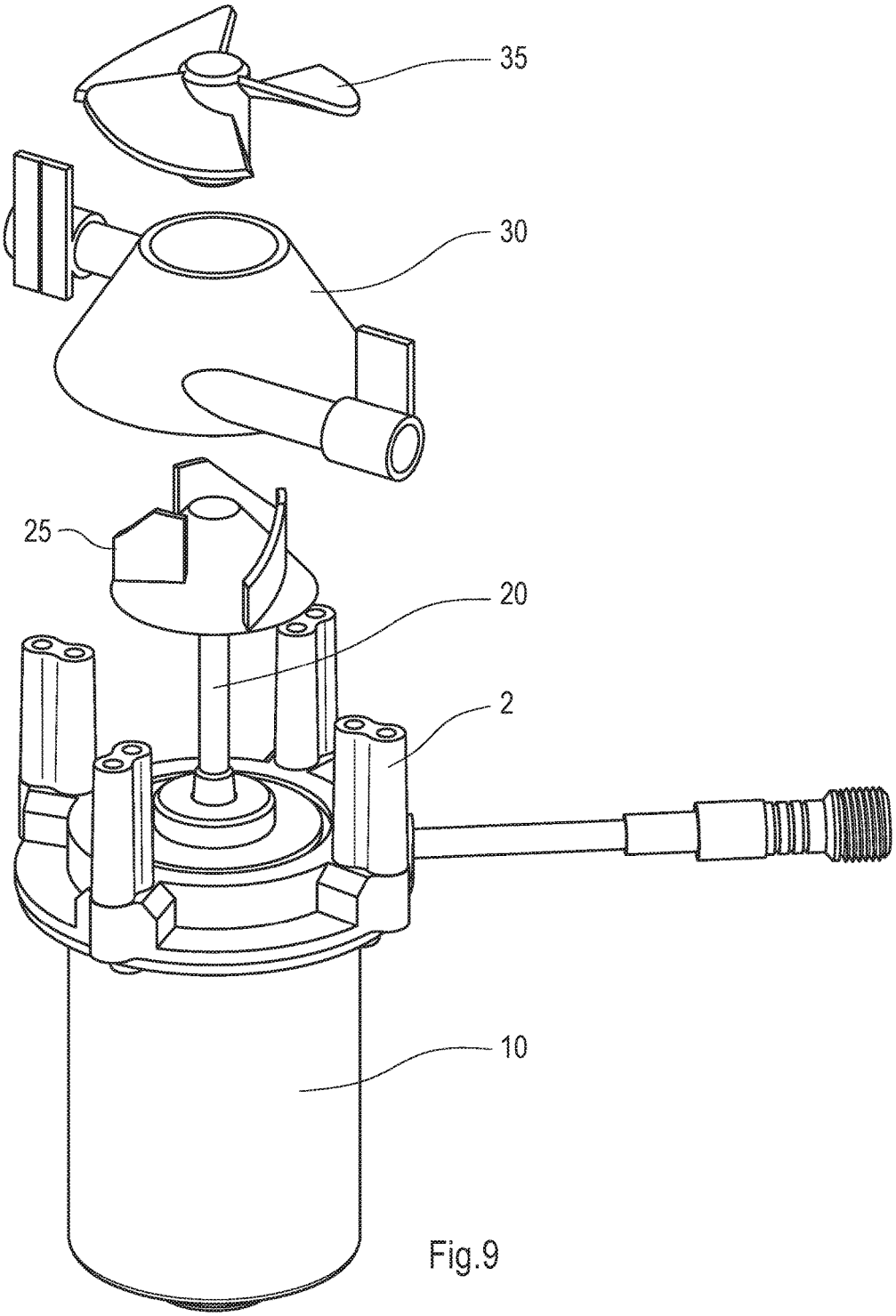
FIG. 9 is an exploded perspective view of the universal motor mount and cap of the present invention mounted on a motor housing with the motor connected to a propeller and pressure wash device.

FIG. 9 shows another advantage of the universal motor mount and cap C of the present invention. The universal motor mount and cap C containing the central through opening 3 accepts the shaft 20 of the motor there through. Once the motor shaft 20 is inserted, additional parts may be installed. Many pool cleaners now utilize pressure cleaners which consist of an impeller 25 and an impeller cover 30. For the pressure washer to work the impeller spins with the shaft 20 of the motor. The impeller cover 30 remains stationary. The impeller cover 30 has a pair of opposing sleeves that can sleeve over two posts of a universal motor mount and cap C to hold it in place. Once the impeller cover 30 is installed the propeller 35 is inserted on the distal end of the motor shaft 20.

The features of the invention illustrated and described herein are the preferred embodiments. Therefore, it is understood that the appended claims are intended to cover unforeseeable embodiments with insubstantial differences that are within the spirit of the claims.

What I claim is:

1. A universal device for capping and mounting a motor within a motorized pool cleaner having either a first sized housing or, alternatively, a second different sized housing, comprising:

a base having an edge and first and second surfaces and a central through opening; and at least first and second sets of generally cylindrical posts, each post having a curved surface, extending generally perpendicular from said first surface of said base, said first set of posts is adapted to engage said first sized housing of the pool cleaner and said second set of posts is adapted to, alternatively, engage said second sized housing of the pool cleaner, wherein said first and second sets of posts each comprises at least two posts;

said first set of posts extending from said first surface of said base adjacent said edge, said first set of posts defining a first footprint;

said second set of posts extending from said first surface of said base and each post of said second set of posts abuts a corresponding post of said first set of posts, wherein a portion of said curved surface of each post of said first set of posts abuts a portion of said curved surface of each corresponding post of said second set of posts, said second set of posts defining a second footprint smaller than said first footprint.

2. The device of claim 1 wherein said first set of posts comprises four posts.

3. The device of claim 1 wherein said second set of posts comprises four posts.

4. The device of claim 1 wherein said device is made of aluminum.

5. The device of claim 1 further comprising a shaft seal within the central through opening and said central through opening is sized and adapted to accept a motor bearing of the motor.

6. The device of claim 5 wherein said shaft seal is a twin lipped radial shaft seal.

7. The device of claim 1 wherein said first footprint and said second footprint are both circular.

8. The device of claim 1 wherein said central through opening further having a bottom gland with a lip adapted to receive an o-ring.

9. The device of claim 1 wherein said base is circular.

10. The device of claim 1 wherein said second surface of said base having a rim defining a potting area between said rim and said central through opening adapted to receive electrical wires of the motor.

* * * * *